US005792319A

United States Patent [19]

Bennett

[11] Patent Number: 5,792,319

[45] Date of Patent: Aug. 11, 1998

[54] METHOD AND APPARATUS FOR CONTROLLING THE PROFILE OF SHEET MATERIAL

[76] Inventor: Larry P. Bennett, 7631 Frosch Rd., Charlotte, N.C. 28208

[21] Appl. No.: 649,776

[22] Filed: May 17, 1996

[51] Int. Cl.[6] ..... D21F 1/06

[52] U.S. Cl. ..... 162/216; 162/259; 162/323; 162/336

[58] Field of Search ..... 162/198, 258, 162/259, 336, 344, 323, 216

[56] References Cited

U.S. PATENT DOCUMENTS

| | | | |
|---|---|---|---|
| 1,240,589 | 9/1917 | Murray | 162/344 |
| 2,540,301 | 6/1951 | Staege | 162/259 |
| 3,413,192 | 11/1968 | Beecher | 162/259 |
| 4,539,074 | 9/1985 | Stenberg | 162/198 |
| 4,574,033 | 3/1986 | Myrén | 162/198 |
| 5,071,514 | 12/1991 | Francis | 162/259 |

*Primary Examiner*—Karen M. Hastings
*Attorney, Agent, or Firm*—Kennedy Covington Lobdell & Hickman, LLP

[57] ABSTRACT

A method and apparatus is disclosed for controlling the flow of stock mixture through an enclosed head box chamber, such as in a paper-making machine, and onto a forming surface thereof. A plurality of plates are arranged in the chamber to extend transversely across the chamber, with the top edges of the plates and the inner wall of the chamber defining therebetween an opening through which the stock mixture flows. The plates are selectively moved toward and away from the inner wall to vary the configuration of the opening and, thus, control the flow of stock mixture through the openings such that selective movement of selected plates controls the cross-sectional flow profile across the width of the chamber and, correspondingly, controls the cross-sectional flow across the width of the outlet from the chamber and onto the surface forming the sheet material.

31 Claims, 10 Drawing Sheets

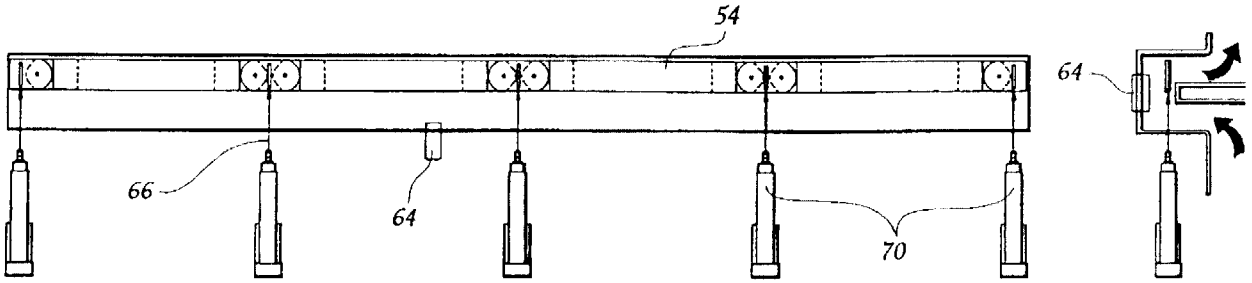
Fig. 4A
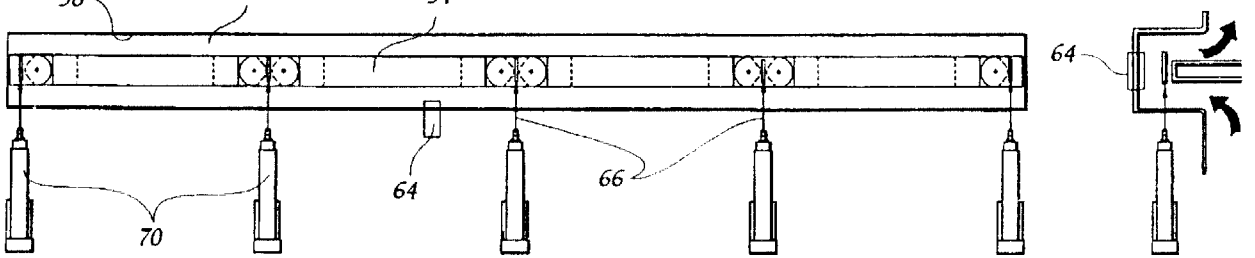
Fig. 4B
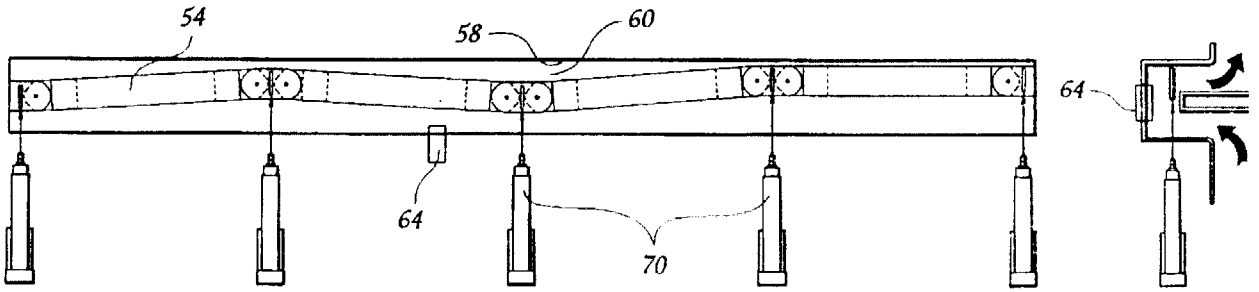
Fig. 5A
Fig. 5B
Fig. 6A
Fig. 6B

METHOD AND APPARATUS FOR CONTROLLING THE PROFILE OF SHEET MATERIAL

BACKGROUND OF THE INVENTION

The present invention relates to a method and apparatus for controlling the profile of sheet material as it is being formed and, more particularly, to maintaining the uniformity of the thickness of sheet material across the width of the sheet.

Often, when producing a sheet material, such as paper, plastics, etc., it is desirable to control the thickness of the sheet to be as uniform as possible across the width of the sheet. For example, in paper-making, if a sheet that varies in thickness across its width is produced, use of such a sheet may cause various problems. If this paper is to be used in any sort of printing application, for example, such varied thickness may result in uneven application of the print to the paper. Such uneven thicknesses would also undermine the strength of any particular sheet of material, wherein the sheet would be more likely to tear, separate, etc., in those areas of the sheet with unacceptably narrow thickness. Such weakness could lead to brittle fracture or other failure of plastic sheet material that hardens after being formed. Therefore, it is desirable to control the uniformity of the thickness of the sheet material to prevent problems in the utilization of the sheet, such as the aforementioned problems with poorly formed plastics and paper.

In paper-making, processed wood pulp is generally mixed with water in a stock chest. This wood pulp and water mixture, referred to as stock mixture, is then pumped from the stock chest through a cylindrical pipe to the wet end of a paper-making machine. Typically, a paper-making machine will generate a continuous sheet of paper that is several feet wide, so the machine is generally several feet wide, and some means must be provided to convert the cylindrical flow of stock mixture within the pipe to a flatter profile to accommodate the width of the paper-forming sections of the paper-making machine.

This can be done by providing an enclosed head box that extends across the entire width of the paper machine, with an inlet for the stock mixture as pumped from the stock chest. Often, the movement of the stock mixture from the pipe into the head box does not result in efficient mixing of the wood pulp fiber within the water, and concentration gradients of the wood pulp fiber occur throughout the head box. To minimize these concentration gradients, the stock mixture is often mixed by the use of offset baffles in the inlet to the head box. The stock mixture traverses the offset baffles and, in the process, is thoroughly mixed.

It is desired that the stock mixture output from the head box have a flat profile to continue onto the forming surface of the paper-making machine. This ensures that the concentration of wood pulp fiber is substantially constant across the entire width of the machine and will then reduce the likelihood that the resulting sheets formed will vary in thickness. Because of the hydraulic dynamics of the stock mixture as it flows through the head box, the flow rate and profile are not always constant across the width of the head box and, consequently, the concentration of pulp fiber within the stock mixture is not evenly distributed. One known method of partially offsetting such adverse hydraulic dynamics of the stock mixture is to include wing boards across the width of the head box that may be used to modify the flow profile of the stock mixture. The wing board positions are fixed, but may be raised or lowered at the edges of the head box to change the slope of the surface over which the stock mixture flows. This results in a vee-shaped surface and the velocity of the stock mixture in the deeper center is faster than the velocity in the shallower sides, resulting in the stock fibers concentrating in the areas of lower flow at the sides. By adjusting these wing boards, some amount of control may be exercised over the stock concentration and profile across the width of the head box. Also, additional "trim" boards will be found to provide additional measures of control. These wing boards and trim boards must be manually repositioned based on the concentration of the wood pulp fiber within the stock mixture.

After the stock mixture passes over these wing boards, it then flows across a making board and into a vat circle. The vat circle is that area between the tub section wall and the forming cylinder. The forming cylinder is a hollow shell structure with a wire of some given mesh on its surface. When the stock mixture enters the vat circle, water is drained into the interior of the forming cylinder and through the outlet from the vat. The wood pulp fibers are deposited on the wire mesh and do not drain through the wire. As the forming cylinder rotates, new screen on the forming cylinder is exposed to the stock mixture, and the wood pulp fiber already deposited on the forming cylinder is carried to the top of forming cylinder and continues on to the next vat or other section of the machine. In this way, paper may be formed of several plies, wherein each vat in series adds another ply to the paper.

Because the head box extends across essentially the entire width of vat, and the stock mixture exits the head box onto the forming cylinder which also extends essentially across the width of the vat, it can be seen that variance in the concentration of fiber within the stock mixture at any given point across that width will result in less fiber being deposited upon the corresponding area of wire mesh of the forming cylinder in that region of lower concentration. Therefore, it is desirable that the concentration of fiber within the stock mixture be uniform throughout the entire width of the head box.

The head box is typically at essentially atmospheric pressure. Thus, vertical repositioning of the wing boards directs faster or slower flow as needed to adjust the concentration of the fiber deposited upon the forming cylinder. If the wing boards are in the "up" position, more flow will be directed at the center of the resulting "vee," which will tend to shed fibers in the stock mixture to either side of its flow. Then, the consistency, or the amount of stock, in the zones on either side of the "vee" will increase. This will result in a low stock area in the center zone and a heavy stock area in side zones. Varying the position of the wing boards will vary the thickness of the stock deposited upon the wire mesh of the forming cylinder.

The "CD" profile is defined as the cross-machine direction profile, which is that direction transverse to the direction of travel of the paper. The "MD" profile is defined as the machine direction profile, which is the profile along the direction of the travel of the paper. The quantity of fibers at various locations across the width of forming cylinder directly affects the resulting CD thickness profile of the paper formed by that particular vat. If the fibers are evenly distributed across the width of the head box, then the resulting CD profile has a relatively consistent thickness. If the stock mixture fibers in the head box are unevenly distributed along the width of head box, then an unsatisfactory CD profile will result. Taking this to its logical conclusion, for a multi-ply paper, such as a cardboard, made with an unsatisfactory CD profile, the resulting paper formed from many plies with the unsatisfactory CD profile will vary widely in thickness across the width of the paper. This is highly undesirable and results in significant lack of uniformity, which makes for a generally unsatisfactory product.

This concentration of wood pulp fiber within the stock mixture is generally discussed in terms of consistency. Freeness, however, is the measure of how many gallons of water will drain through so many pounds of stock in a given length of time. A stock mixture that will drain a lot of water for a given weight is deemed to have high freeness. A stock mixture that has been highly refined and, therefore, acts very much like filter paper, will drain a lot less water in a given period of time and is referred to as having low freeness.

If the freeness of the material in the stock chest is changed, then the position of the wing boards and the configuration of the baffles must also be changed to match the freeness of the stock mixture. This requires shutting down the paper-making machine. Whenever the machine is shut down, it is not producing the sheet material, and money is lost by this lack of production.

There has been a substantial amount of money and many efforts made to attempt to control the profile of the sheet material across the width of the machine. Some examples include Beecher U.S. Pat. No. 3,413,192, Stenberg U.S. Pat. No. 4,539,074 and Myren U.S. Pat. No. 4,574,033.

SUMMARY OF THE INVENTION

It is an object of the present invention to provide a method and apparatus for automatically controlling the profile of a sheet-forming material, such as paper, plastics, etc., in the head box chamber through which the sheet-forming material flows as it is being formed into a sheet. It is a further object of the present invention to be able to control this profile without shutting the machine down to make the profiling adjustments.

The present invention provides a method and apparatus for controlling the flow of sheet-forming material, such as paper, plastics, etc., through an enclosed head box chamber, such as in a paper-making machine, and onto a forming surface thereof. The apparatus includes a plurality of plates arranged in the enclosed chamber to extend transversely across the chamber. The top edges of the plates and the inner wall of the chamber define therebetween an opening through which the stock mixture of sheet-forming material flows.

Attached to the plates is an arrangement for selectively moving the plates toward and away from the inner wall to vary the configuration of the opening therebetween, whereby the flow of the stock mixture through the head box chamber may be controlled and directed, as desired, to accommodate the hydraulic dynamics of the mixture. In this way, an even concentration of stock mixture may be presented at the exit of the head box chamber so that the resulting sheet formed from the stock mixture has uniform thickness in a direction transverse to the movement of the sheet material.

The positions of the plates may be selectively controlled by a controller receiving input signals corresponding to the thickness of the sheet from a location downstream of the formation of the sheet, in order to control the flow profile of the stock mixture through the head box chamber. This provides an efficient feedback method to quickly correct any variations in the thickness of the sheet in a direction transverse to the movement of the sheet or the "cross direction."

BRIEF DESCRIPTION OF THE DRAWINGS

FIG. 4A illustrates one position of the plates of the present invention;

FIG. 4B illustrates a side view of FIG. 4A;

FIG. 5A illustrates another arrangement of the plates of the present invention;

FIG. 5B illustrates a side view of FIG. 5A;

FIG. 6A illustrates another arrangement of the plates of the present invention;

FIG. 6B illustrates a side view of FIG. 6A;

DETAILED DESCRIPTION OF THE PREFERRED EMBODIMENT

Figure 1:
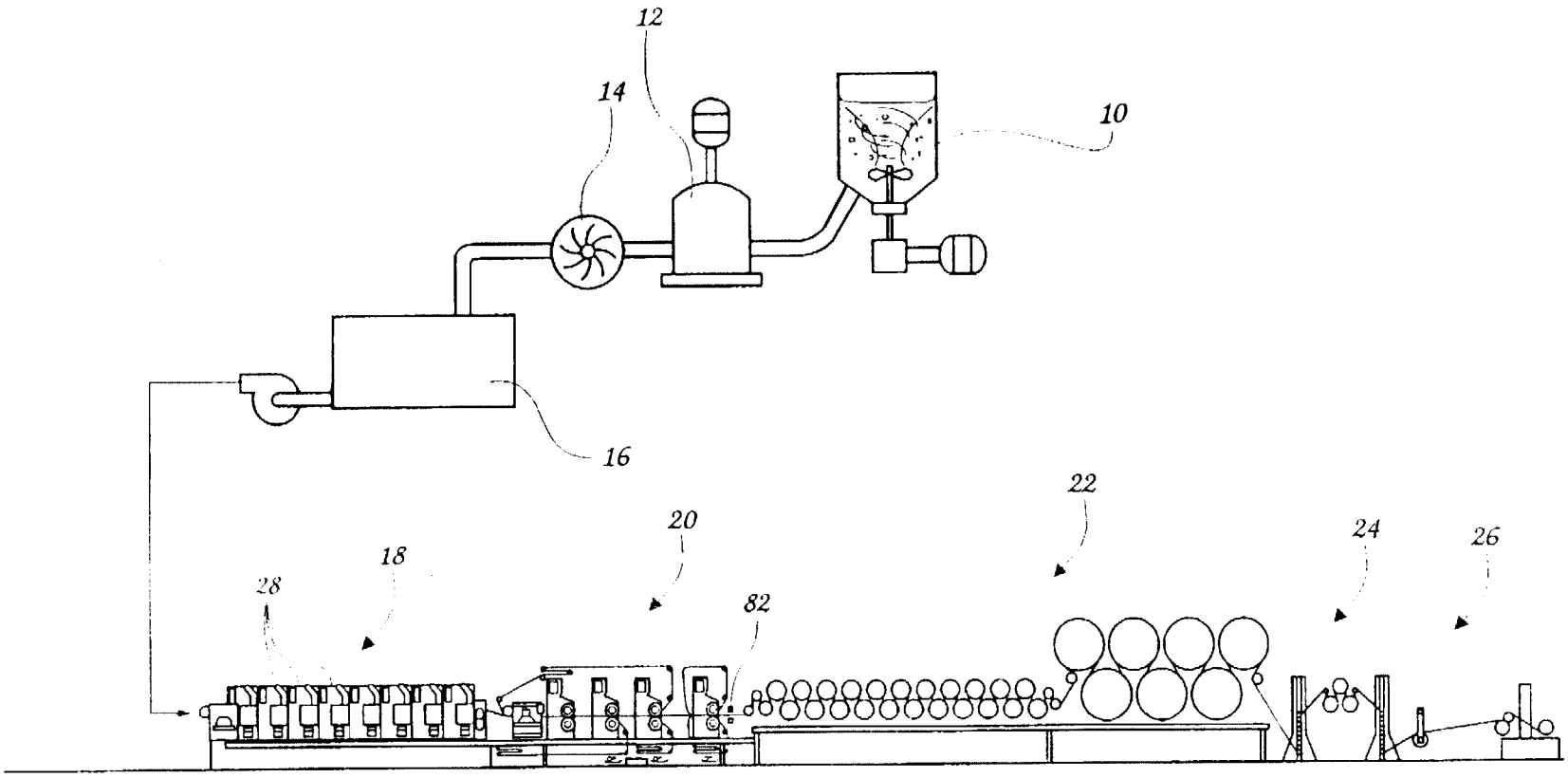
FIG. 1 is a schematic representation of a typical paper-making process.

While the present invention may be used to produce a variety of sheet materials from a fluid mixture, the invention will be detailed with respect to its use in a paper-making machine. FIG. 1 illustrates a typical paper-making machine, wherein wood chips or bales of waste paper are fed into a pulper 10 where the wood is agitated in an aqueous solution to unlock the wood fibers such that they become random fibers in an aqueous solution, and this mixture is then passed through a screener 12 that removes any staples, bolts, or other such foreign matter from the aqueous pulp mixture. The mixture then passes through a refiner 14 that refines the wood pulp fiber, and it is then passed to a stock chest 16 after which it is ready to go to a paper-forming section 18. After the stock mixture is formed into a sheet of paper in the paper-forming section 18, it is passed into a press section 20 that removes all the water from the sheet that can be mechanically removed, and it then goes on to a dryer section 22 which further dries the sheet. The sheet is then passed through a calendar stack 24 to provide a polished finish to the paper, and the finished paper is then transferred to a winder or sheeter 26.

The forming section 18 typically contains one or more vats 28 that form the paper, each of which is typically several feet wide, in order to produce a sheet of paper with a width of several feet. Each vat 28 includes an inlet 30, by which the stock mixture enters the vat, and a series of baffles 32 navigated by the stock mixture before entering an enclosed head box 34 that distributes the stock mixture onto the forming cylinder surface (not shown) and converts the flow from the cylindrical flow of the inlet pipe to the flat flow needed to place the stock on the forming cylinder.

Figure 2:
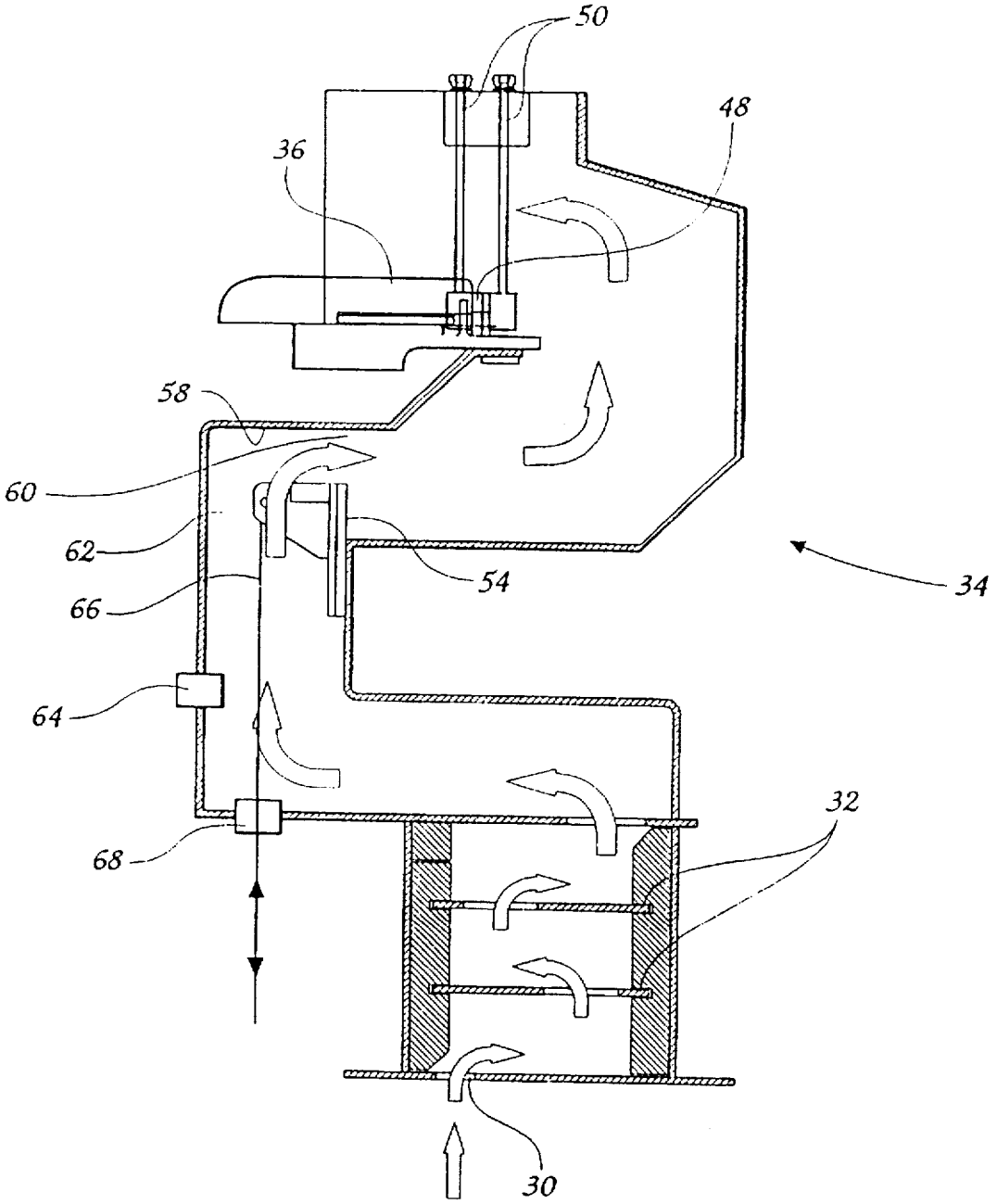
FIG. 2 is a cross-sectional view of a head box chamber in a vat of the forming section of FIG. 1 incorporating the present invention.

As illustrated in FIG. 2, the present invention includes a plurality of first plates 54 within the enclosed head box 34. The head box 34 includes an inner wall 58, and the top edges of the plates 54 and the inner wall 58 of the chamber define therebetween an opening 60 through which the stock mixture flows.

The head box 34 further defines a plenum 62 upstream of the plates 54 and downstream of the baffles 32. A pressure sensor 64 is located in this plenum 62 for measuring the pressure of the stock mixture therein. Control rods 66 are attached to the plates 54 and extend through the wall of the head box 34 in the plenum 62. The control rods 66 are connected to linear actuators 70 (see FIGS. 4A, 5A, and 6A) which are operated to move the control rods 66 in a linear direction, as will be explained in greater detail below. A bushing 68 is provided for each control rod 66 so that the control rod 66 moves in a linear direction, and none of the stock mixture is permitted to exit the plenum 62 at the location where the control rods 66 extend through the head box 34, all as explained in greater detail below. The plates 54 extend transversely across the head box 34 and are moved by the control rods 66 in a direction generally perpendicular to the flow of the stock mixture.

Figure 3A:
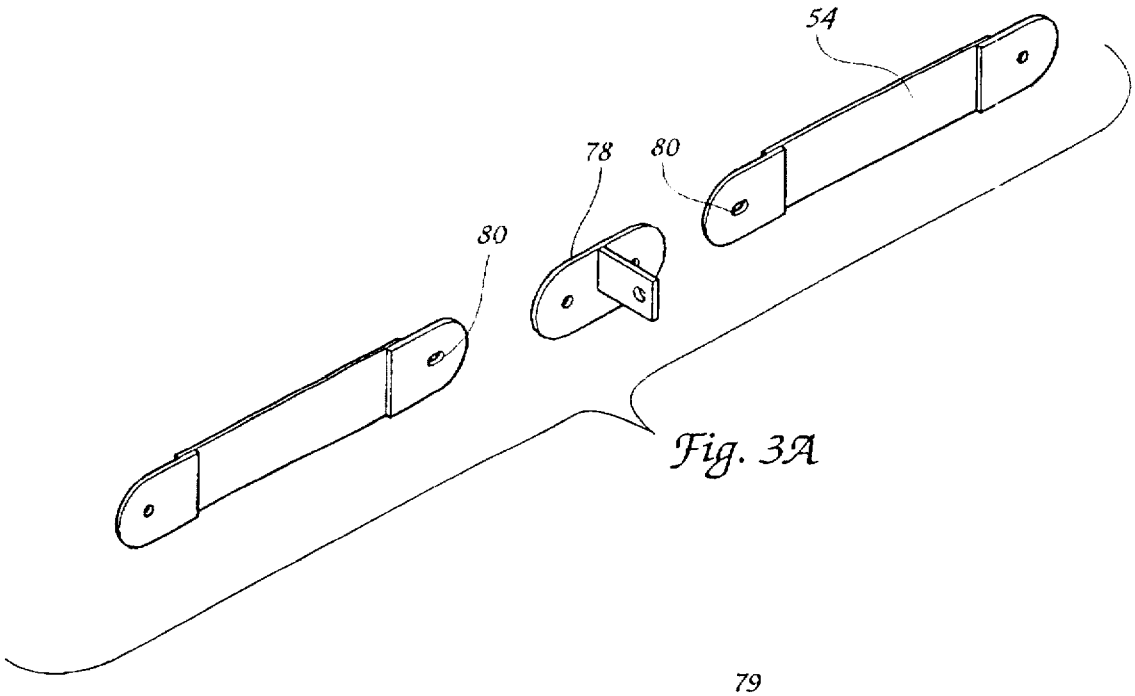
FIG. 3A illustrates the connecting arrangement of plates in one embodiment of the present invention.
Figure 3B:
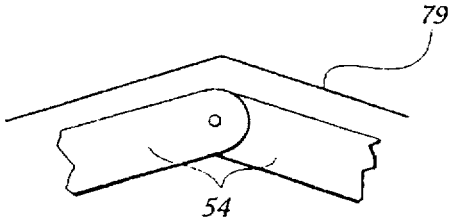
FIG. 3B illustrates a flow profile segment according to one embodiment of the present invention.
Figure 3C:
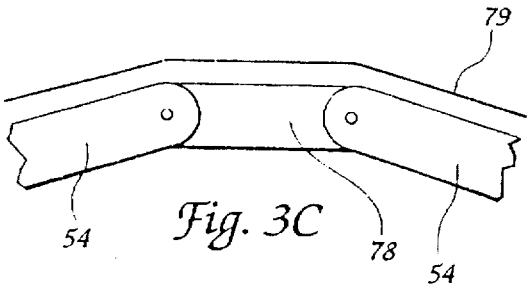
FIG. 3C illustrates a flow profile segment according to another embodiment of the present invention.

One embodiment of the present invention is illustrated in FIGS. 3A and 3C in which each plate 54 is connected to each adjacent plate 54 by a bracket 78. The control rods 66 are attached to the brackets 78 to cause movement of the brackets 78 as the control rods 66 are moved up and down by the linear actuator 70, with a corresponding movement in the plates 54. Some plates 54 may be connected to the brackets 78 by means of a slot 80 which allows one end of a plate 54 to move without corresponding movement of the other end of the plate 54.

Another embodiment of the present invention is illustrated in FIG. 3B in which the brackets are omitted and the adjacent ends of the plates 54 are connected together by a pivot pin to which a control rod 66 is connected (not shown).

As can be seen by comparing FIG. 3B with FIG. 3C, the flow profile 79 of the stock mixture over the brackets 78 tends to be smoother than the flow profile 79 of the mixture over the plates 54 without a corresponding bracket 78. Variations in the widths of the bracket 78 will result in corresponding variations of the abruptness of the angles of the flow profile over the bracket 78. Typically, a smoother profile is desired to minimize extremes in the profile and the resulting sheet.

As illustrated in FIG. 3A, both end portions of each plate 54 are offset by a dimension corresponding to the thickness of the bracket 78 so that the bracket 78 fits into such offset and provides a flat continuous surface across the back face of the plates 54 which is in abutment with the adjacent wall of the head box 34, whereby pivotal and linear movement of the plates 54 across such wall will be smooth.

The embodiment illustrated in FIGS. 4A–6A and 4B–6B includes four plates 54 that are arranged lengthwise to extend across the width of the head box 34, with the ends of the plates 54 being pivotally connected to one another and with control rods 66 being connected to each of the pivot points and at the ends of the end plates 54.

In FIGS. 4A and 4B, the top edge of each of the plates 54 is very close to the inner wall 58 of the head box 34 such that the opening 60 therebetween is small, and the pressure drop across the first plates 54, as measured by the pressure sensor 64, is high. In the position illustrated in FIGS. 5A and 5B, the top edges of plates 54 are located at a greater distance from the inner wall 58, such that the opening 60 is much larger, and the pressure drop across the first plates 54 is much less than when the plates 54 are in the position illustrated in FIG. 4A. FIGS. 6A and 6B illustrate the plates 54 positioned in angular relation to one another so that the opening 60 has a variable height across its transverse extent to thereby vary the amount of the stock mixture that is flowing over the top edges of the plates 54 across the width of the head box 34, and the flow profile across the width of the head box 34 will correspond to the shape of the opening 60. An increased pressure drop will be experienced if the control rods 66 are higher, and a decreased pressure drop will be experienced if the control rods 66 are positioned lower.

Figure 7:
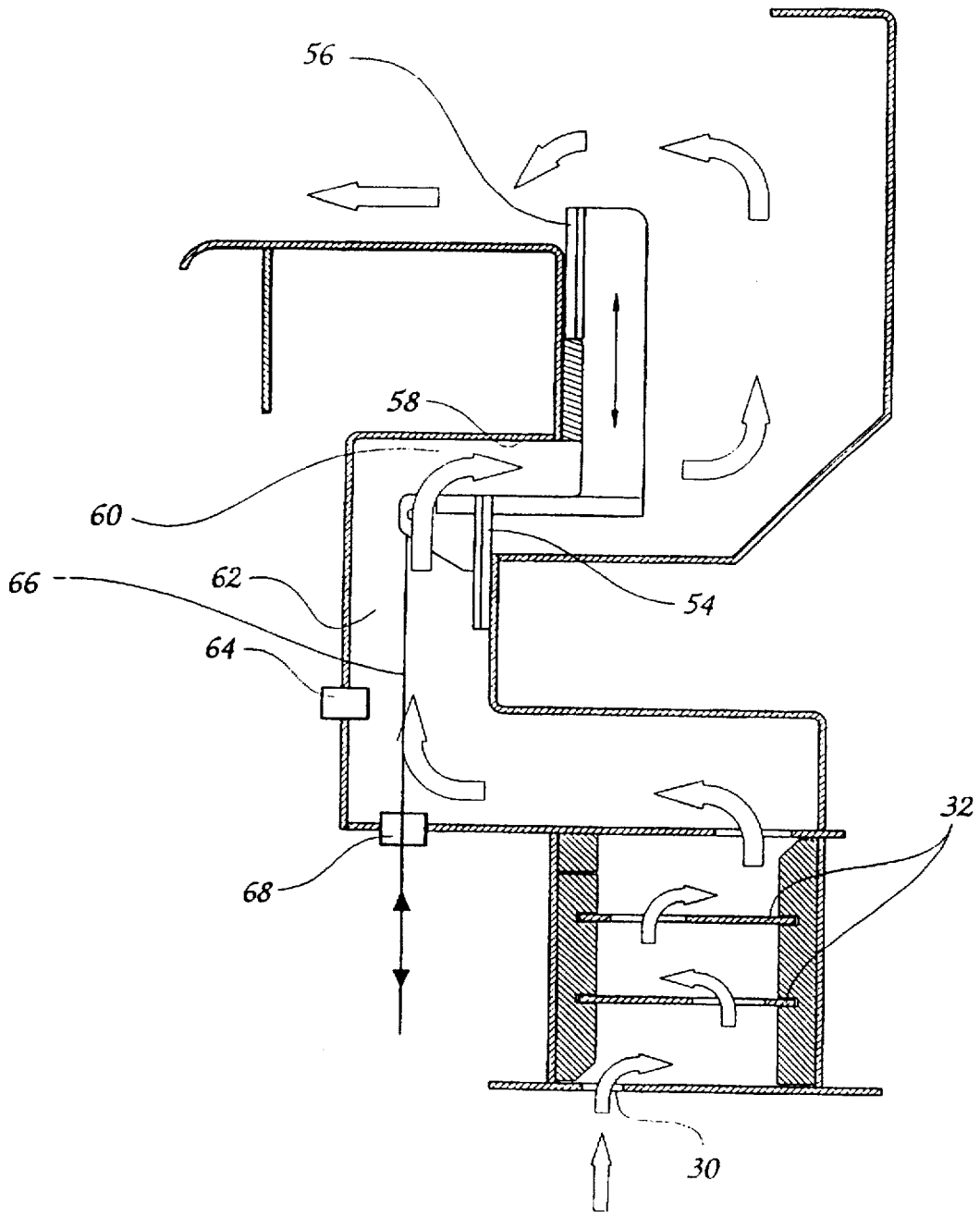
FIG. 7 illustrates another embodiment of the present invention.
Figure 8:
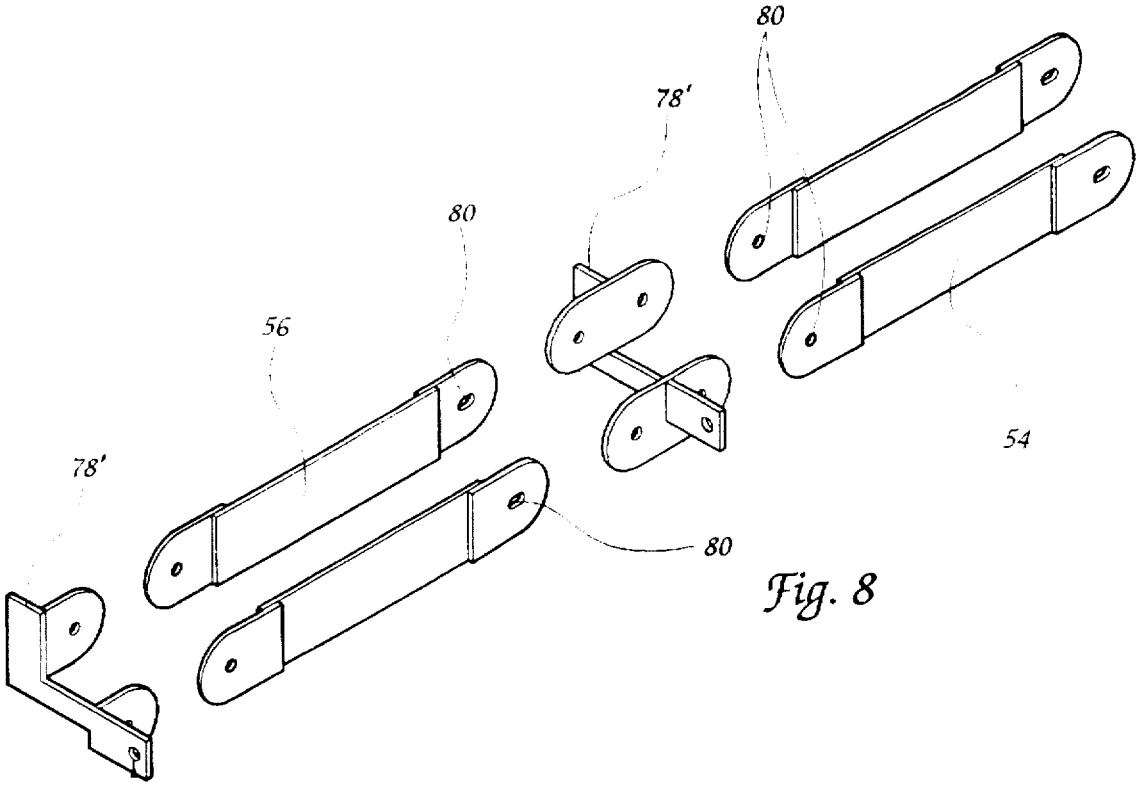
FIG. 8 illustrates the connecting arrangement of plates in one embodiment of the present invention.

In contrast to the embodiment illustrated in FIG. 2 where only one set of plates 54 is used, the alternate embodiment, illustrated in FIG. 7, includes second plates 56 located downstream from and connected to the first plates 54, such that movement of the first plates 54 results in a corresponding movement in the second plates 56, and there is an identical number of plates in both sets. As illustrated in FIG. 8, the same bracket 78' that connects first plates 54 may also be used to connect correspondingly adjacent plates 56 in the second set, and the control rods 66 are attached at one end to the bracket 78' and at the other end to the linear actuators 70, so that the first plates 54 and the second plates 56 move together.

Figure 9:
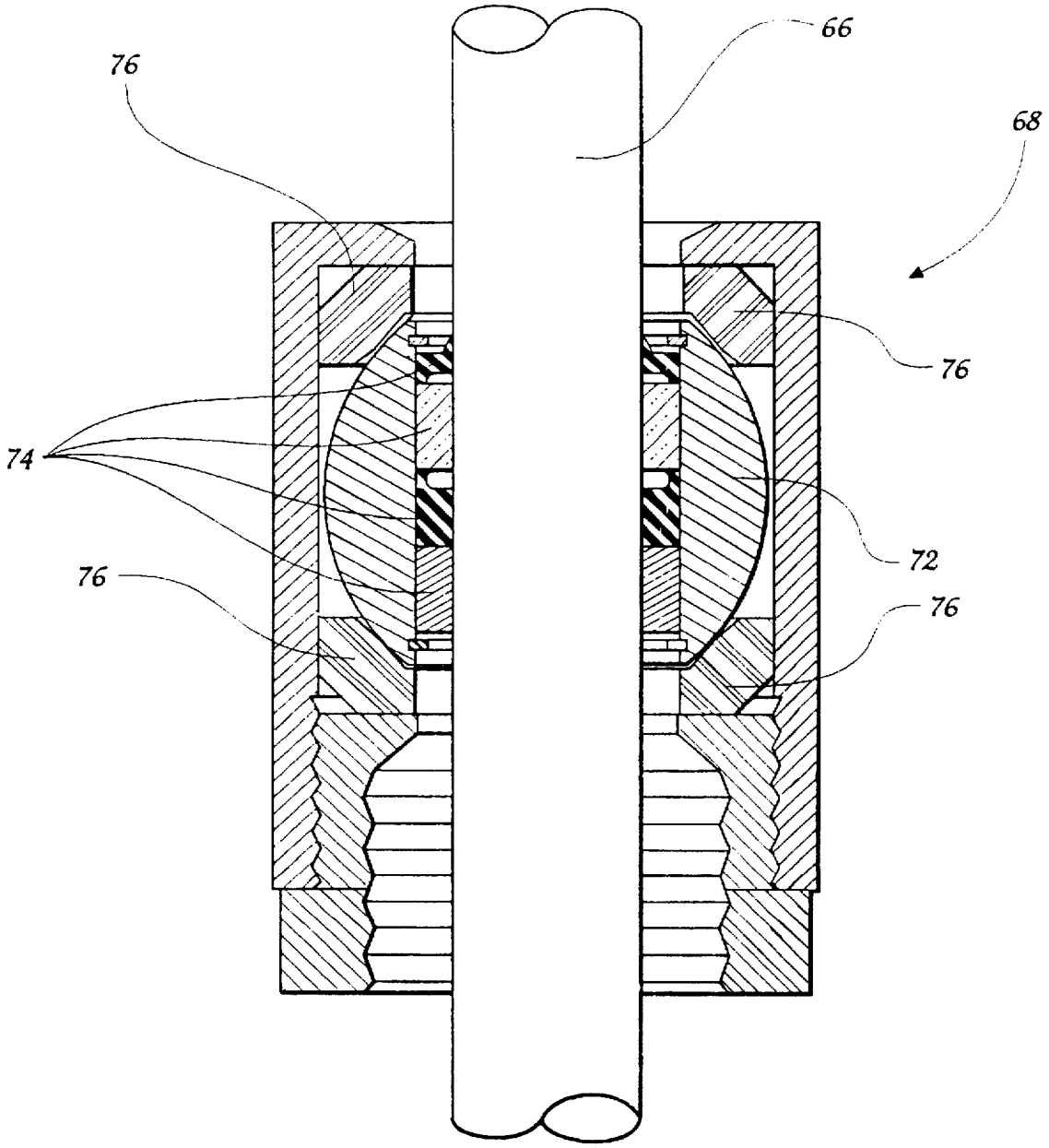
FIG. 9 illustrates a cross-sectional view of a bushing used in the present invention.

FIG. 9 illustrates a bushing 68 that is used at the location where each control rod 66 extends through the head box 34. Because the materials from which the head box 34 and control rods 66 are made will slightly expand or contract when heated or cooled, the temperature changes in the control rods 66, or in any of the materials surrounding the control rods 66, might tend to cause binding of the control rods 66 such that they cannot move to adjust the position of the plates 54, or might cause the control rods 66 to slightly warp, resulting in a non-linear movement of the control rods 66 and in corresponding non-linear movement of the plates 54. To avoid this problem, the bushing 68 is welded to the head box 34 at each location where control rods 66 extend through the head box 34, and each bushing 68 includes a truncated ball 72 with packings 74 therein. The ball 72 is set within plastic seals 76 that allow the ball 72 to float relatively freely, allowing the control rods 66 to twist and move inside the bushing 68 without binding or warping.

As discussed earlier, the dynamics of the flow of the stock mixture under low to no pressure causes the stock mixture in the areas of low flow to thicken and the amount of fiber contained therein increases. However, when the stock mixture is placed under pressure, the dynamics of the flow change considerably. By closing one flow area and opening up another flow area, more flow, and more stock, will now flow to the open area. With a pressurized system, the stock concentration does not vary as much as in a non-pressurized system, and greater flow means that there is a greater amount of stock in that greater flow region. Thus, by increasing or decreasing the flow in one region, precise control of the amount of stock in that region is possible. If there is no pressure drop in the region, then the flow tends to behave exactly as previously discussed. Accordingly, when the flow is under pressure, the amount of flow can be regulated to put stock exactly where it is desired.

Freeness, as previously discussed, is a measure of how many gallons of water will drain through so many pounds of stock in a given length of time. Stock that has been highly refined and, therefore, acts very much like filter paper, will drain a lot less water in a given period of time and has a low freeness. On the other hand, stock that has not been highly refined, and can be said to generally resemble toothpicks, will drain a lot more water in a given period of time and has a high freeness.

Freeness ranges of stock mixtures that run on paper machines are from about 150 to about 500 Canadian standard freeness. If a conventional machine is set to run with stock with a freeness of from 325 to 350 and if the freeness of the stock approaches 500, the edges will be thicker and the resulting sheet of material will have a profile that looks like a "V"; it will be thinner in the center and thicker at both edges. This is because the longer stock ("toothpicks") will go more with the flow than the 350 freeness stock for which the machine is set. On the other hand, if the stock has a low freeness and comes to a conventional machine that is set for a 350 freeness, the center of the sheet will be thicker and the two edges will be thinner.

If the flow is in a conduit that is open on the top, as is the case in the region in which the second plates 56 are located, where there is little or no pressure drop, the stock will tend to settle in areas of low flow. On the other hand, if the flow is an area of high pressure drop, such as in the region where the first plates 54 are located, the stock will tend to go with the flow. In the present invention, by controlling the position of the first plates 54, where there is a pressure drop across such plates 54, the profile of the stock mixture across the entire width of the head box 34 is controlled.

The amount of control exercised by the first plates 54 is dependent upon the magnitude of the pressure drop across such plates. Within the plenum 62, the pressure sensor 64 measures the pressure of the stock mixture in the plenum 62 and to compares it with essentially atmospheric pressure at the second plates 56. If the pressure drop across the first plates 54 is significant, then the position of the first plates 54 affects the flow profile more than does the position of the second plates 56. A typical desirable pressure drop is approximately 3 psi, although other pressure drops are contemplated. This is important when other vats 28 in the forming section 18 are to be adjusted, as well, to maintain consistency. It is desirable to maintain this given pressure drop across the first plates 54 regardless of the position of any of the individual plates 54.

For example, if the configuration in FIG. 6A is necessary to form the sheet to have a uniform thickness, but the pressure drop is 5 psi instead of the desired 3 psi, all control rods 66 could then be lowered exactly the same amount so that the profile is maintained but the pressure drop is brought back to 3 psi. Thus, the magnitude of the pressure drop across the first plates 54 may be controlled without modifying the configuration of the plates 54 or the thickness profile of the sheet.

The second plates 56 operate similarly to conventional wing boards 48 previously discussed and seemingly opposite to the control exerted by the first plates 54, because of the flow dynamics in a region without significant pressure drop. Because the pressure drop across the second plates 56 is low relative to the pressure drop across the first plates 54, balancing the methods of control of the first plates 54 and the second plates 56 results in a much higher form of trim or a much higher form of trim balance and uniform delivery than if just one set of plates 54 is used with conventional wing boards 48 (see FIG. 2). In fact, it is possible to lower the first plates 54 to a point where the dominant control can be transferred to the second plates 56, depending upon the pressure drop across first plates 54. Thus, it may be selected which type, or which balance, of control is desired based upon the circumstances surrounding the profile of the sheet. This is true whether the second plates 56 are not present, whether wing boards 48 are present and adjusted by wing board adjustments 50, or whether there is no other profile controlling apparatus downstream of the first plates 54. Similar control dynamics are experienced if wing boards 48, instead of the second plates 56, are present with the first plates 54. If there is no profile control apparatus downstream of the first plates 54, then control can be exercised with only the first plates 54.

In the present invention, the flow of stock mixture comes through the inlet 30, through the baffles 32 wherein it is mixed, and into the plenum 62. The plurality of plates 54 are adjusted with respect to the inner wall 58 of the head box 34 to create an opening 60 therebetween. The stock mixture then flows through the opening 60 into the area downstream of the first plates 54, at a predetermined pressure drop across the first plates 54. Each plate 54 is positioned to vary the size and configuration of the opening 60 to selectively control the amount of flow of the stock mixture past each plate 54 to control the flow profile of the stock mixture across the entire width of the head box 34. The movement of the plates 54 is effected by control rods 66 attached to linear actuators 70, which may be hydraulically or pneumatically operated. In the embodiment illustrated in FIG. 7, the stock mixture then flows over the second plates 56, at little or no pressure drop and into the paper-forming region of the vat 28. It can be seen that, with this arrangement, and with the first plates 54 and the second plates 56 being connected with each other, it is no longer necessary to have the wing boards 48 or an associated making board 36. In this way, the profile of the stock mixture across the entire width of the head box 34 may be controlled to result in a uniformly even thickness to the sheet resulting from the forming section 18.

Figure 10A:
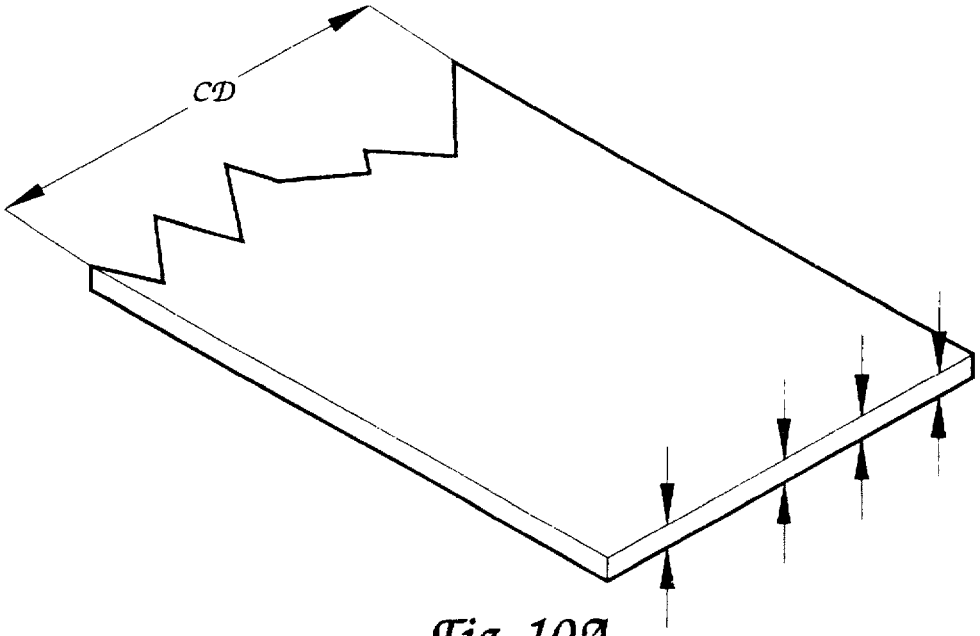
FIG. 10A illustrates a sheet made by the present invention exhibiting uniform thickness.
Figure 10B:
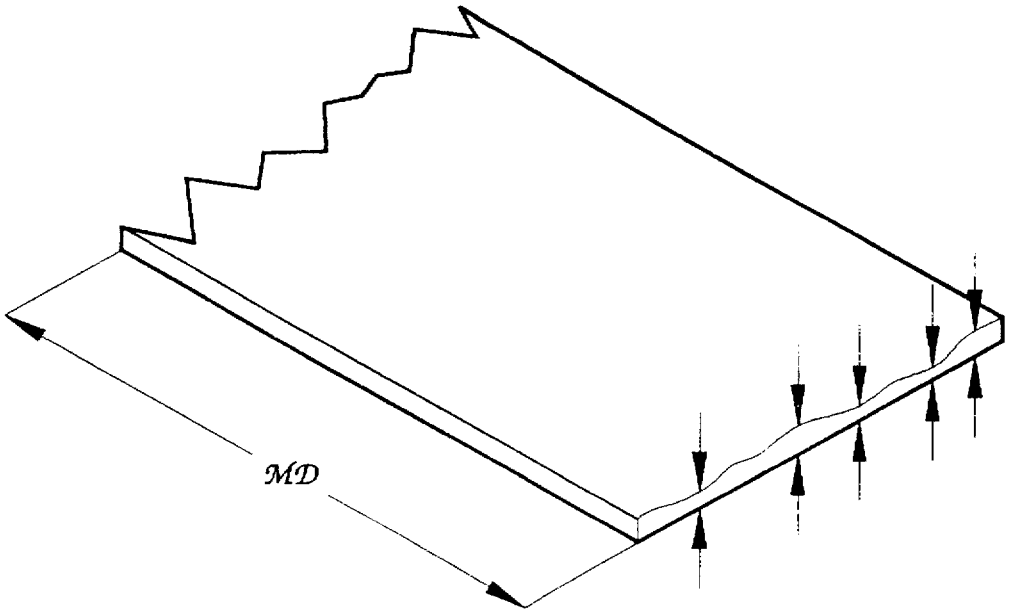
FIG. 10B illustrates a sheet formed with an undesirable and uneven thickness across the width of the sheet.

FIG. 10A illustrates a portion of a sheet made in accordance with the present invention that has a desirable, even CD thickness profile. FIG. 10B illustrates a portion of a sheet with an undesirable, uneven CD thickness profile and an MD profile which can be controlled by machine speed, etc.

Figure 11B:
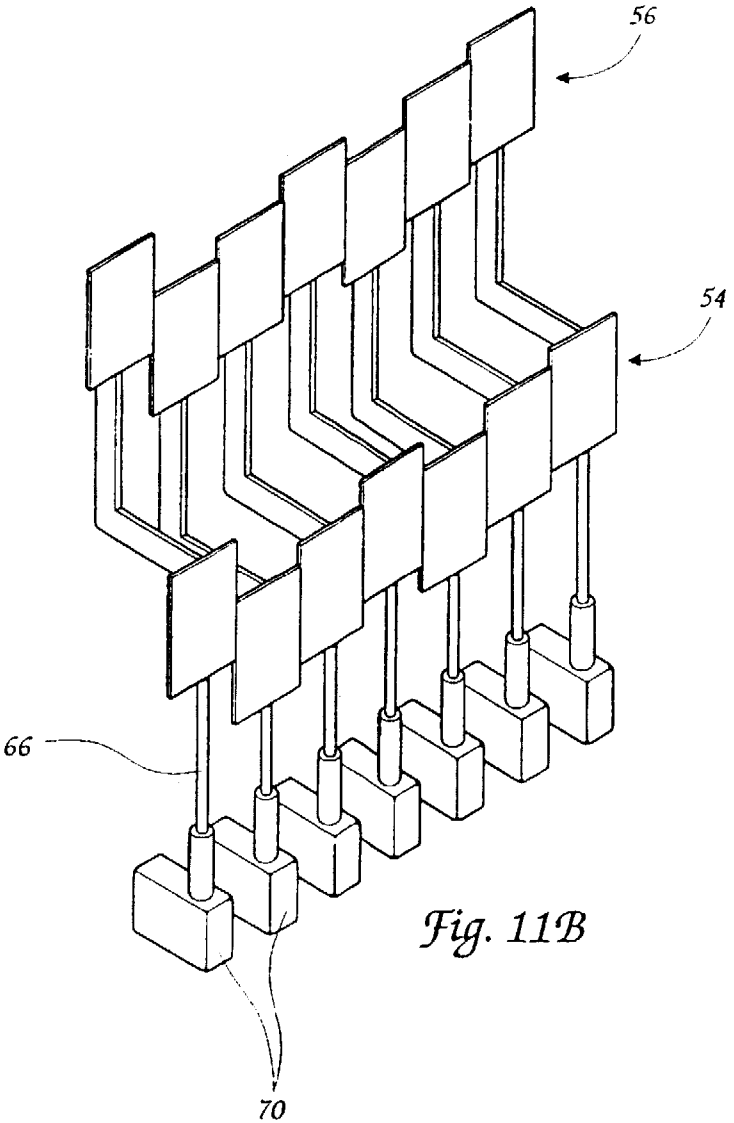
FIG. 11B illustrates the plates of yet another embodiment of the present invention.
Figure 11A:
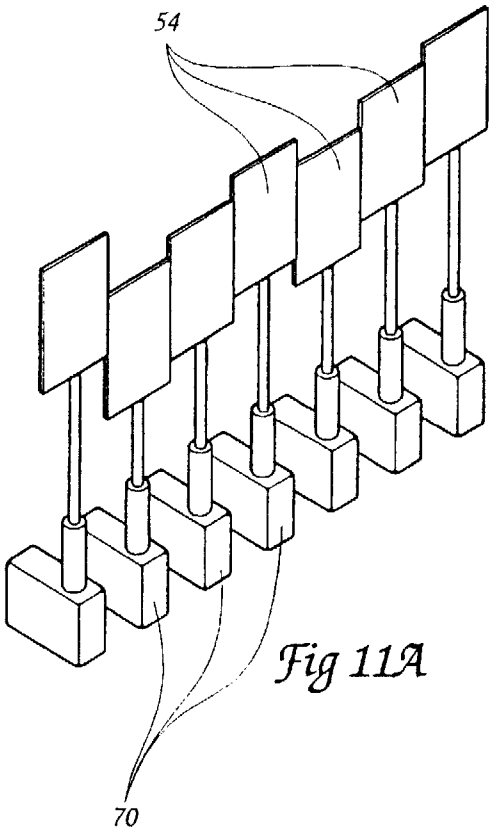
FIG. 11A illustrates the plates of yet another embodiment of the present invention.

FIG. 11A illustrates another embodiment of the present invention, wherein the first plates 54 are not connected to each adjacent plate 54, and the control rods 66 act upon each individual plate 54 to position each plate 54 individually. In this embodiment, a larger number of smaller plates 54 are used, and it is particularly applicable to Fourtinier paper machines or other types of sheet-making machines, such as machines for making plastic sheets.

FIG. 11B illustrates yet another embodiment of the present invention, wherein the individual first plates 54 like those illustrated in FIG. 11A are connected to second plates 56.

An important consideration in controlling the profile of the stock mixture across the width of the head box 34 is to exercise such control so as to minimize unsatisfactory variations in thickness profile, such as those illustrated in FIG. 10B. Because of the nature of the use and configuration of the plates 54 connected to the control rods 66 extending through the head box 34 to connect with linear actuators 70 situated outside of the vat 28, the present invention is well situated for automatic control of the position of the plates 54, without the need to shut down the machine to control the position of the plates 54 and the profile of the resulting sheet.

Figure 12:
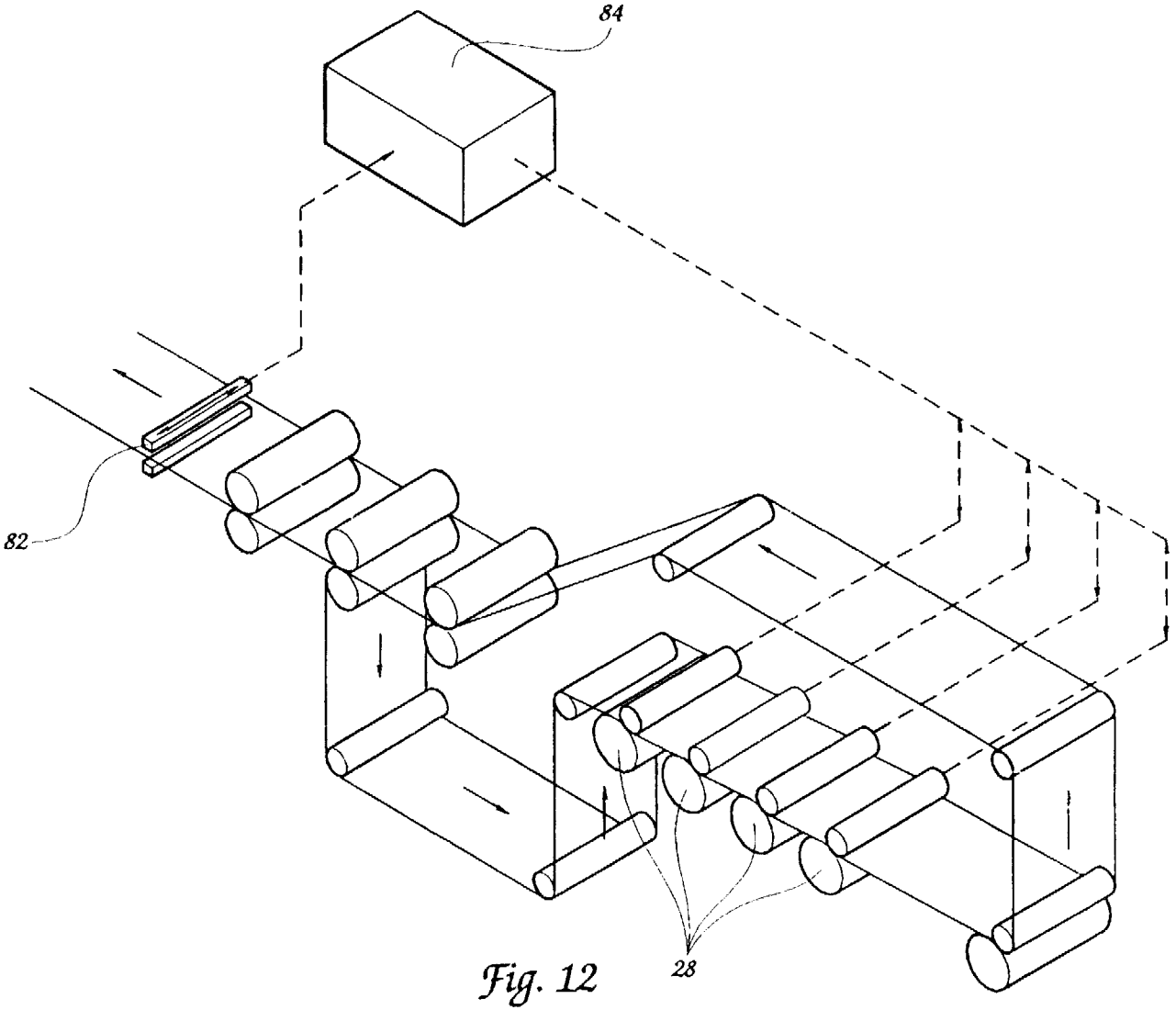
FIG. 12 illustrates a schematic representation of the automatic control system of the present invention.

At a location downstream of the vat 28, a conventional scanning device 82 is located, as illustrated in FIG. 12, that scans the formed sheet to determine the CD profile. The scanning device 82 is moved back and forth continuously across the sheet to measure this profile and determines exactly how much paper fiber is present in each given inch of the sheet in the CD direction. The scanning device 82 transmits a signal that is a function of the sensed profile to a controller 84, such as a computer, which then controls the position of each of the plates 54 through actuation of the linear actuators 70. This signal may be used also in conjunction with the output signal from the pressure sensor 64 to maintain a predetermined pressure drop across the first plates 54. The controller 84 works in conjunction with the scanning device 82, the pressure sensor 64, and the linear actuators 70 to incrementally alter the position of the plates 54 until the desired CD profile in the sheets is obtained. Because the speed of these machines can run up to thousands of feet per minute, the time between the changing of the position of the plates 54 and the effect of this change being noted by the scanning device 82 is short. Thus, very fine and delicate control of the CD profile may be maintained by the present invention.

The number, width, thickness, height, and other specific dimensions of the plates 54, and the corresponding number, length, and other dimensions of control rods 66 may be modified to fit the particular circumstances without any departure from the spirit of the invention. It will be apparent that the use of more plates 54 across the width of the head box 34 will provide a finer control of the stock profile across the head box 34, but the use of more plates 54 also requires more control rods 66 penetrating the head box 34 and more linear actuators 70. Thus, the number of plates 54 needed to meet the particular circumstances may be adjusted to effectuate a desired balance.

The linear actuators 70 may be any conventional means of linear actuation wherein the control rods 66 move in a linear manner so that the plates 54 move only in a direction generally transverse to the direction of the flow of the stock mixture, and any suitable and conventional scanning device 82 may be used without departing from the spirit of the invention.

It will be obvious to one of ordinary skill in the art that the invention, as described herein, may be used with any type of machine designed to form sheet material. While the detailed description discloses its use with respect to a paper-making machine, the invention may be practiced with any machine capable of making sheet material.

It will also be obvious to one of ordinary skill in the art that the material of construction of the invention described herein may be of any suitable material, without departing from the spirit of the invention. The material of construction chosen to practice the invention is a function of the circumstances surrounding the particular need and is not a limitation of this invention.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus in combination with an enclosed headbox chamber for controlling the flow of stock mixture which includes a sheet-forming material through the enclosed head box chamber and exiting the head box through an outlet onto a forming surface for forming a sheet of the material, comprising:

a first plurality of plates arranged in said enclosed chamber to extend transversely thereacross with the top edges of said plates and the inner wall of said chamber defining therebetween an opening upstream of the head box outlet through which the stock mixture flows while substantially filling the opening; and means attached to said plates for selectively moving said plates toward and away from said inner wall to thereby vary the configuration of said opening; structured and arranged so that said movement of selected plates controls the flow of stock mixture through the openings between individual plates and the chamber wall such that selective movement of selected plates increases or decreases the pressure drop and the flow of the stock mixture past said individual plate and thus controls the cross-sectional flow profile across the width of the chamber and, correspondingly, controls the cross-sectional flow across the width of the outlet and onto the forming surface.

2. The apparatus of claim 1, wherein each said plate has means for moving attached thereto, and each said plate is moved individually.

3. The apparatus of claim 2, wherein each said plate may be moved independently of any other said plate.

4. The apparatus of claim 1, wherein each said plate is connected to each adjacent plate by a bracket.

5. The apparatus of claim 4 wherein a linear actuator is attached to each bracket and to an end of each end plate.

6. The apparatus of claim 5, wherein the attachment of selected plates to the brackets is through slots, said slots being arranged to enable the one end of each plate to move with the bracket independently of the other end of such plate.

7. The apparatus of claim 1 wherein the first plurality of plates is comprised of a first set of plates, and a second set of plates is located downstream of the first set of plates, each set of plates arranged in said enclosed chamber to extend transversely thereacross with the top edges of said plates and the inner wall of said chamber defining therebetween an opening through which the stock mixture flows, the stock mixture flowing over the second set of plates not completely filling the opening between the second set of plates and the inner wall of the chamber.

8. The apparatus of claim 7, wherein the second set of plates is connected to the first set of plates and to a linear actuator of said plates.

9. The apparatus of claim 8, wherein there is an identical number of plates in the first set of plates and in the second set of plates.

10. The apparatus of claim 9 wherein the movement of a plate in the first set of plates results in a corresponding movement of a companion plate in the second set of plates.

11. The apparatus of claim 9, wherein each plate in the first set of plates is connected to each adjacent plate by a bracket, said bracket being connected to the linear actuator and extending to connect corresponding adjacent plates in the second set of plates.

12. The apparatus of claim 1 wherein there are four plates, with five connections to the means for moving said plates.

13. The apparatus of claim 1, wherein the means for moving said plates includes a plurality of control rods attached, respectively, to each plate at one end and to a linear actuator at the other end, wherein each control rod is connected to one linear actuator, and whereby each linear actuator imparts linear movement to the corresponding control rod with coinciding parallel movement of said plates.

14. The apparatus of claim 13, wherein the control rods extend through the enclosed head box.

15. The apparatus of claim 14, further including means for preventing leakage of stock mixture from the enclosed head box at the location where the control rods extend through the enclosed head box.

16. The apparatus of claim 15, wherein the means for preventing leakage is a bushing at each said location.

17. The apparatus of claim 1, wherein a controller controls the movement of the plates.

18. The apparatus of claim 17, wherein the controller controls the movement of the plates based on an input signal received from a scanning device located downstream of the enclosed head box that scans the sheet profile.

19. The apparatus of claim 17, wherein a pressure sensor is located upstream of the plates to measure the pressure of said stock mixture thereat and to transmit a signal which is a function of said pressure to the controller, wherein the controller controls the movement of the plates based on an input signal received from said pressure sensor.

20. The apparatus of claim 19, wherein the input signal is further based on a signal received from a scanning device located downstream of the enclosed head box that scans the sheet profile.

21. The apparatus of claim 17, wherein the controller is a computer.

22. A method of controlling the flow of stock mixture which includes a sheet-forming material through an enclosed head box chamber and exiting the head box through an outlet onto a forming surface for forming a sheet of the material, comprising the steps of:

(a) supplying a source of stock mixture to the inlet of the chamber;

(b) providing a first plurality of plates arranged in said enclosed chamber to extend transversely thereacross with the top edges of said plates and the inner wall of said chamber defining therebetween an opening upstream of the head box outlet through which the stock mixture flows;

(c) passing the flow of the stock mixture through said opening while substantially filling said opening;

(d) selectively positioning each plate to vary the size and configuration of said opening to selectively control the amount of flow of the stock mixture past each plate to control the flow profile of the stock mixture across the width of the chamber; and (e) discharging the stock mixture with the controlled flow profile from the chamber onto the forming surface.

23. The method of claim 22, further including the steps of scanning the profile of the sheet downstream of the head box and controlling the movement of the plates based upon the sheet profile.

24. The method of claim 22, further including the steps of measuring the pressure in the head box upstream of the plates and controlling the movement of the plates based upon this pressure.

25. The method of claim 22, further including the steps of scanning the profile of the sheet downstream of the head box, measuring the pressure in the head box upstream of the plates, and controlling the movement of the plates based upon the sheet profile and the upstream pressure.

26. The method of claim 22, wherein the step of selectively positioning the plates includes providing that the plates move independently of one another.

27. The method of claim 22, wherein the step of selectively positioning the plates includes connecting the plates with brackets such that movement of one bracket will result in the movement of two plates about the bracket.

28. The method of claim 22, wherein said first plurality of plates includes a first set of plates, and a second set of plates is located downstream of the first set of plates.

29. The method of claim 28, further including the steps of moving the first and second sets of plates together, and adjusting the positions of the plates such that the flow profile of the stock mixture is predominantly controlled by the first set of plates.

30. An apparatus in combination with an enclosed headbox chamber for controlling the flow of stock mixture which includes a sheet-forming material through the enclosed head box chamber and exiting the head box through an outlet onto a forming surface for forming a sheet of the material, including:

a first plurality of plates arranged in said enclosed chamber to extend transversely thereacross with the top edges of said plates and the inner wall of said chamber defining therebetween an opening upstream of the head box outlet through which the stock mixture flows while substantially filling said opening;

a plurality of brackets, each of which connects adjacent plates;

a plurality of control rods, each of which attaches to one bracket at one end;

a plurality of linear actuators, each of which is attached to the other end of a single control rod for selectively moving said plates toward and away from said inner wall to thereby vary the configuration of said opening;

a pressure sensor located upstream of the plates to measure the pressure of said stock mixture thereat and which generates a signal that is a function of said pressure;

a scanning device located downstream of the enclosed head box to scan the sheet profile and generate a signal which is a function of said profile; and a computer that controls the movement of the plates based on the signals received from the scanning device and the pressure sensor;

structured and arranged so that said movement of selected plates controls the flow of stock mixture through the openings between individual plates and the chamber wall such that selective movement of selected plates increases or decreases the flow of the stock mixture past said individual plate and thus controls the cross-sectional flow profile across the width of the chamber and, correspondingly, controls the cross-sectional flow across the width of the outlet and onto the forming surface.

31. The apparatus of claim 30, wherein the first plurality of plates includes a first set of plates, and a second set of plates is located downstream of the first set of plates, each set arranged in said enclosed chamber to extend transversely thereacross with the top edges of the plates and the inner wall of said chamber defining therebetween an opening through which the stock mixture flows, wherein the brackets extend from the first set of plates to connect corresponding adjacent plates in the second set of plates, and movement of the control rods by the linear actuators results in a corresponding movement of both the first and second sets of plates.

* * * * *